US008294352B2

(12) United States Patent
Ohmi et al.

(10) Patent No.: US 8,294,352 B2
(45) Date of Patent: Oct. 23, 2012

(54) FLUORESCENT LAMP

(75) Inventors: Tadahiro Ohmi, Miyagi (JP); Yasuyuki Shirai, Miyagi (JP)

(73) Assignee: Tohoku University, Sendai-Shi (JP)

( * ) Notice: Subject to any disclaimer, the term of this patent is extended or adjusted under 35 U.S.C. 154(b) by 106 days.

(21) Appl. No.: 11/918,068

(22) PCT Filed: Nov. 15, 2005

(86) PCT No.: PCT/JP2005/020919

§ 371 (c)(1),
(2), (4) Date: Nov. 15, 2007

(87) PCT Pub. No.: WO2006/051979

PCT Pub. Date: May 18, 2006

(65) Prior Publication Data

US 2008/0197762 A1 Aug. 21, 2008

(30) Foreign Application Priority Data

Nov. 15, 2004 (JP) ..... 2004-330262

(51) Int. Cl.
*H01J 1/62* (2006.01)

(52) U.S. Cl. ..... 313/486; 313/485

(58) Field of Classification Search ..... 313/318.01–318.12, 484–193, 313/623; 345/47
See application file for complete search history.

(56) References Cited

U.S. PATENT DOCUMENTS

| | | | | |
|---|---|---|---|---|
| 5,731,659 | A * | 3/1998 | Soules et al. | 313/487 |
| 6,081,069 | A * | 6/2000 | Matsuda et al. | 313/461 |
| 6,281,625 | B1 * | 8/2001 | Tachibana et al. | 313/489 |
| 6,528,938 | B1 * | 3/2003 | Jansma | 313/485 |
| 2004/0206935 | A1 * | 10/2004 | Miura et al. | 252/301.4 S |

FOREIGN PATENT DOCUMENTS

| | | | |
|---|---|---|---|
| JP | 2000-156202 | A | 6/2000 |
| JP | 2000-336353 | A | 12/2000 |
| JP | 2001-303045 | A | 10/2001 |
| JP | 2001303045 | A * | 10/2001 |
| JP | 2003-027051 | A | 1/2003 |
| JP | 2003-187750 | A | 7/2003 |

* cited by examiner

*Primary Examiner* — Anh Mai
*Assistant Examiner* — Elmito Breval
(74) *Attorney, Agent, or Firm* — Foley & Lardner LLP

(57) ABSTRACT

In a fluorescent lamp, a fluorescent material has a particle size of not greater than 1 μm and a thickness of not greater than 5 μm. With this structure, ultraviolet ray of 254 nm is efficiently converted into visible light and the light obtained by conversion is efficiently emitted to the outside.

3 Claims, 1 Drawing Sheet

| | PARTICLE SIZE OF FLUORESCENT MATERIAL (μm) | THICKNESS OF FLUO-RESCENT LAYER (μm) | LUMINANCE AT THE CENTER PORTION (cd/m2) | DIFFERENCE IN LUMINANCE BETWEEN UPPER AND LOWER TWO POINTS (cd/m2) |
|---|---|---|---|---|
| LEVEL 1 | 0.5 | 0.8 | 4000 | 10 |
| LEVEL 2 | 0.5 | 1.3 | 3600 | 20 |
| LEVEL 3 | 0.5 | 2.0 | 3200 | 40 |
| LEVEL 4 | 0.5 | 4.0 | 2500 | 60 |
| LEVEL 5 | 0.5 | 10.0 | 500 | 100 |
| LEVEL 6 | 4.0 | 4.0 | < 100 | — |
| LEVEL 7 | 4.0 | 10.0 | 300 | > 150 |

| | PARTICLE SIZE OF FLUORESCENT MATERIAL (μm) | THICKNESS OF FLUO-RESCENT LAYER (μm) | LUMINANCE AT THE CENTER PORTION (cd/m2) | DIFFERENCE IN LUMINANCE BETWEEN UPPER AND LOWER TWO POINTS (cd/m2) |
|---|---|---|---|---|
| LEVEL 1 | 0.5 | 0.8 | 4000 | 10 |
| LEVEL 2 | 0.5 | 1.3 | 3600 | 20 |
| LEVEL 3 | 0.5 | 2.0 | 3200 | 40 |
| LEVEL 4 | 0.5 | 4.0 | 2500 | 60 |
| LEVEL 5 | 0.5 | 10.0 | 500 | 100 |
| LEVEL 6 | 4.0 | 4.0 | < 100 | — |
| LEVEL 7 | 4.0 | 10.0 | 300 | > 150 |

FLUORESCENT LAMP

This application is the National Phase of PCT/JP2005/020919, filed Nov. 15, 2005, which claims priority to Japanese Application No. 2004-339262, filed Nov. 15, 2004. The contents of the foregoing applications are incorporated by reference in their entirety.

TECHNICAL FIELD

This invention relates to a fluorescent lamp and, in particular, to a fluorescent lamp for use in a backlight of a liquid crystal display.

BACKGROUND ART

A fluorescent lamp is widely used as a light source of an interior lamp, a street lamp, various types of home electric appliances, and so on. In such a fluorescent lamp, a decompressed glass tube is used. Generally, the decompressed glass tube comprises a glass tube having an inner wall coated with a fluorescent material. In the glass tube, a rare gas, such as a neon gas and an argon gas, and a small amount of mercury are confined. In the glass tube, discharge electrodes are also disposed. By applying an electric voltage between the discharge electrodes, discharge occurs to excite or stimulate mercury so that ultraviolet ray having a wavelength of 254 nm is emitted. When the ultraviolet ray is irradiated to the fluorescent material, the fluorescent material is excited to emit visible light. Thus, the lamp is realized.

The fluorescent lamp is classified into a hot cathode fluorescent lamp for emitting thermal electrons to excite mercury and a cold cathode fluorescent lamp for emitting electrons by applying an electric voltage between electrodes, thereby exciting mercury. Both of the hot cathode fluorescent lamp and the cold cathode fluorescent lamp perform light emission when the fluorescent material is excited by the ultraviolet ray of 254 nm emitted by the excited mercury and emits the visible light.

Generally, a glass tube is used as a discharge tube. The fluorescent material is generally classified into a long-wavelength excitation type (red) material, a medium-wavelength excitation type (green) material, and a short-wavelength excitation type (blue) material. For example, a white lamp emits white light by mixing red, green, and blue materials in a desired ratio. The fluorescent material generates visible light when a dopant such as europium present on its surface is excited.

Generally, the fluorescent material has a particle size not smaller than 2 μm. The fluorescent material is applied onto the inner wall of the lamp so that the ultraviolet ray emitted inside the lamp is irradiated to the fluorescent material to cause the visible light to be emitted outside the lamp. For this purpose, the fluorescent material is formed as a layer having a thickness of about 10 μm.

Japanese Unexamined Patent Application Publication (JP-A) No. 2003-027051 discloses the technique using a composite fluorescent material comprising a fluorescent material having a small particle size and adhered to an inorganic compound having a large particle size.

For the fluorescent lamp known as a low-power-consumption lamp, a yet higher efficiency is pursued and lower power consumption is required in view of energy consumption. In particular, a cold cathode lamp used as a backlight of a liquid crystal display of a home electric appliance, such as a personal computer and a television, accounts for a high percentage of power consumption and, in case of a large liquid crystal television of 32 inch or more, the percentage is as high as about 40% of power consumption thereof. Therefore, the cold cathode lamp is required to have yet lower power consumption for use in a home electric appliance of low power consumption.

DISCLOSURE OF THE INVENTION

Problem to be Solved by the Invention

In order to realize lower power consumption of the cold cathode lamp, it is necessary to improve its luminous efficiency. However, a conventional fluorescent material has a large particle size so that an effective surface area is small. It is therefore difficult to efficiently convert the ultraviolet ray of 254 nm into the visible light. Further, since the thickness of the fluorescent material is large, it is difficult to efficiently emit the light obtained by conversion to the outside.

Further, in the cold cathode lamp for a liquid crystal display, there is a problem in uniformity of luminance in the lamp. This is a phenomenon caused by nonuniformity or irregularity in a fluorescent layer and causing a significant damage in quality of the display. The factor causing the nonuniformity in the fluorescent layer resides in a production process of the fluorescent lamp. Specifically, the production process of the fluorescent lamp includes a step of preparing a solvent with a fluorescent material of a large particle size dispersed therein, applying the solvent onto the inner wall of the lamp, and drying the solvent. During this step, the fluorescent material of the large particle size precipitates by gravity towards a lower part, i.e., in a direction of the gravity to cause the nonuniformity in the fluorescent layer. Therefore, it is necessary to improve an applying method. However, a fundamental solution is not reached yet in the present status.

It is an object of this invention to achieve lower power consumption of a fluorescent lamp and to provide a fluorescent lamp improved in luminous efficiency and free from nonuniformity in luminance.

Means to Solve the Problem

A fluorescent lamp according to this invention is characterized in that a fluorescent material for a fluorescent layer formed on an inner wall of a lamp tube has an average particle size of not greater than 1 μm and not smaller than 0.01 μm.

In the fluorescent lamp according to this invention, it is preferable that the fluorescent layer has a thickness of not greater than 5 μm and not smaller than 0.1 μm.

In the fluorescent lamp according to this invention, it is preferable that the fluorescent material comprises a mixture of a long-wavelength excitation type (red) material, a medium-wavelength excitation type (green) material, and a short-wavelength excitation type (blue) material.

EFFECT OF THE INVENTION

According to this invention, the fluorescent layer is formed with an optimum thickness by the use of the fluorescent material having a small particle size. Thus, it is possible to produce the fluorescent lamp excellent in luminous efficiency and free from nonuniformity in luminance.

BEST MODE FOR EMBODYING THE INVENTION

Figures 1, 2:
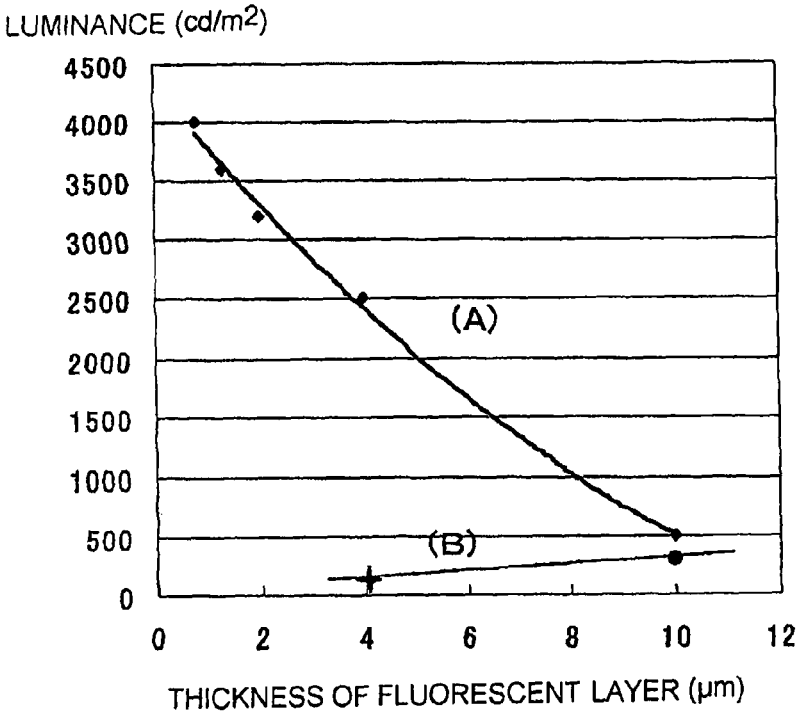
FIG. 1 is a view showing the result of measurement of luminance in case where a particle size and a layer thickness of a fluorescent material are varied.
FIG. 2 is a view showing the relationship between the layer thickness and the luminance of the fluorescent material.

As a fluorescent material in this invention, use may be made of a typical fluorescent material such as barium/magnesium/aluminum salt doped with europium. The fluorescent material has a particle size which is preferably not greater than 1 μm, more preferably not greater than 0.7 μm, further preferably not greater than 0.5 μm.

If the particle size of the fluorescent material is greater than 1 μm, not only the luminous efficiency is degraded but also fluorescent particles precipitate during application to cause nonuniformity in a fluorescent layer. Further, the particle size of the fluorescent material being smaller than 0.01 μm is not preferable because the efficiency of production of the fluorescent material is degraded. Herein, the particle size is an average particle size which will simply be called a particle size hereinafter.

A method of producing the fluorescent material is not specifically limited. Generally, a method of grinding or pulverizing a block of the fluorescent material is used. Alternatively, use may be made of a method of finely divide a film produced by vapor deposition or sputtering or a method of growing very small crystal nuclei. In order to obtain a uniform particle size, it is effective to use a screening method or a separating method using precipitation in a liquid.

The thickness of the fluorescent layer using the fluorescent material of a small particle size is preferably not greater than 5 μm, more preferably not greater than 3 μm, further preferably not greater than 1 μm. The thickness of the fluorescent layer being greater than 5 μm not preferable because the fluorescent layer becomes dense to degrade an efficiency of emission of visible light to the outside of the lamp. The fluorescent layer having a thickness of smaller than 0.1 μm is not preferable because of the difficulty in production. A method of applying the fluorescent material is not specifically limited. Generally, use is made of a method of preparing a solvent obtained by dissolving a polymer such as nitrocellulose and adjusting a viscosity, dispersing the fluorescent material in the solvent to obtain a dispersion liquid, and applying the dispersion liquid. For example, use is generally made of a method of inserting one end of a glass tube into the dispersion liquid to suck the dispersion liquid and discharging the dispersion liquid to apply the same. In case of a planar lamp, application may be carried out by spin coating or a method of dropping the dispersion liquid and spreading the dispersion liquid by a flat rod such as a doctor blade.

Example 1

A fluorescent material having a particle size of 1 μm and prepared by a pulverizing method was supplied into a butyl acetate solvent obtained by dissolving nitrocellulose and increased in viscosity, dispersed by agitation, and left for 10 minutes. Then, it was confirmed that the fluorescent material did not precipitate at the bottom of the solvent. As a comparative example, a typical fluorescent material was dispersed in a similar solvent. In this case, it was confirmed that the fluorescent material precipitated after lapse of one minute.

As the fluorescent material, use may be made of a typical fluorescent material such as a barium/magnesium/aluminum salt doped with europium. The fluorescent material is generally classified into a long-wavelength excitation type (red) material, a medium-wavelength excitation type (green) material, and a short-wavelength excitation type (blue) material. For example, a white lamp emits white light by mixing the three types of materials in a desired ratio. The fluorescent material generates visible light when a dopant such as europium on its surface is excited.

The fluorescent material in this invention does not precipitate in the solvent and, therefore, does not precipitate in a step of applying the fluorescent material to the fluorescent lamp and drying the fluorescent material. Therefore, the fluorescent material is uniformly present throughout the entirety during application. Consequently, a coating film has a large effective surface area so that the luminous efficiency is increased. Since the fluorescent material is uniformly present in the coating film so that nonuniformity is eliminated. As a result, it is possible to suppress nonuniformity in luminance. Further, since the luminous efficiency is improved, lower power consumption is achieved.

Example 2

The dispersion liquid prepared in Example 1 was applied by dip coating onto a borosilicate glass plate of 40 mm square and 1 mm thick in a state where one surface of the plate was covered with a mask. After removing the mask, the dispersion liquid was sintered at 400° C. to form a fluorescent layer having a thickness of 2 μm (fluorescent-material-applied glass A). Ultraviolet ray of 254 nm was irradiated to the plate on the side coated with the fluorescent layer. The luminance of the uncoated side was measured.

Similarly, a sample with a fluorescent layer having a thickness of 10 μm was prepared by the use of the same dispersion liquid (fluorescent-material-applied glass B) and another sample with the fluorescent layer having a thickness of 10 μm and a particle size of 3 μm was prepared (fluorescent-material-applied glass C). Then, the luminance was measured.

As a result of measurement, it was confirmed that the fluorescent-material-applied glass A had the luminance as high as seven times that of the fluorescent-material-applied glass B and three times that of the fluorescent-material-applied glass C. In the fluorescent-material-applied glass C, nonuniformity in luminance was confirmed. On the other hand, in the fluorescent-material-applied glass A, nonuniformity in luminance was not confirmed.

The fluorescent lamp according to the example of this invention is free from nonuniformity in luminance. Further, the fluorescent lamp having a higher luminance and lower power consumption is obtained.

Example 3

As an example 3, in the manner similar to the example 2, fluorescent materials of different particle sizes were applied by dip coating to different thicknesses onto a borosilicate glass plate of 40 mm square and 1 mm thick in a state where one surface of the plate was covered with a mask. After removing the mask, sintering at 400° C. was carried out. Thus, various kinds of fluorescent layers having different particle sizes and different thicknesses were formed. Ultraviolet ray of 254 nm was irradiated to the side coated with each of the various kinds of the fluorescent layers. The luminance of the uncoated side was measured. The levels and the result of measurement are shown in FIGS. 1 and 2.

The luminance with the fluorescent material of a particle size of 0.5 μm is depicted by a line (A) in FIG. 2. The luminance with the fluorescent material of a particle size of 4 μm is depicted by a line (B) in FIG. 2. The luminance with the fluorescent material having a particle size of 0.5 μm is 4000

(cd/m$^2$) at the thickness of 0.8 μm and 500 (cd/m$^2$) at the thickness of 10 μm. As the thickness of the fluorescent layer is smaller, the luminance at the center portion is higher. As the thickness is greater, the luminance is lower. Further, the difference in luminance (nonuniformity) is small as the thickness of the fluorescent layer is smaller. As the thickness of the fluorescent layer is smaller, the fluorescent lamp having a better luminous efficiency and free from nonuniformity in luminance is obtained.

In case where the fluorescent material has a particle size of 4 μm, the fluorescent layer can not be applied to a small thickness. Therefore, in case of the thickness of 4 μm, a uniform thickness can not be obtained. In case of the thickness of 10 μm, the luminance is as low as 300 (cd/m$^2$) and the nonuniformity in luminance is as high as 150 or more, as compared with the fluorescent material having a particle size of 0.5 μm. Thus, as the particle size of the fluorescent material is smaller, the luminous efficiency is higher and the nonuniformity in luminance is smaller.

From the above-mentioned result of measurement, the particle size of the fluorescent material is preferably not greater than 1 μm, more preferably not greater than 0.7 μm, and further preferably not greater than 0.5 μm. The particle size of the fluorescent material being greater than 1 μm is not preferable because not only the luminous efficiency is degraded but also fluorescent particles precipitate during application to cause nonuniformity in luminance. Further, the particle size of the fluorescent material being smaller than 0.01 μm is not preferable because the efficiency in production of the fluorescent material is degraded.

The thickness of the fluorescent layer using the fluorescent material of a small particle size is preferably not greater than 5 μm, more preferably not greater than 3 μm, further preferably not greater than 1 μm. The thickness of greater than 5 μm is not preferable because the fluorescent layer becomes dense so that the efficiency of emission of visible light to the outside of the lamp is degraded. The fluorescent layer having a thickness of smaller than 0.1 μm is not preferable because of the difficulty in production.

In the fluorescent lamp according to this invention, the effective surface area of the fluorescent material is increased and the conversion efficiency is increased by the use of the fluorescent material of a small particle size. By reducing the thickness of the fluorescent layer, the visible light obtained by conversion by the fluorescent material can be efficiently emitted to the outside of the lamp. Further, the fluorescent material having a small particle size can be dispersed in a Brownian motion area and does not precipitate when it is dispersed in the solvent during the production process. Therefore, it is possible to eliminate nonuniformity during application. As a result, it is possible to control nonuniformity in luminance within the fluorescent lamp.

Although this invention has been described in detail in connection with several examples, this invention is not limited to the above-mentioned examples but may be modified in various manners without departing from the gist thereof.

Industrial Applicability

The fluorescent lamp according to this invention is particularly suitable as a backlight source for a liquid crystal display but may be used also as other light sources without being limited thereto.

The invention claimed is:

1. A fluorescent lamp wherein a fluorescent material for a fluorescent layer formed on an inner wall of a lamp tube has an average particle size of not greater than 0.5 μm and not smaller than 0.01 μm, wherein said fluorescent layer has a thickness of not greater than 5 μm and not smaller than 0.1 μm, and wherein said fluorescent lamp has a luminance of not smaller than 2500 cd/cm$^2$ and a difference in luminance between an upper point and a lower point of not greater than 60 cd/cm$^2$.

2. The fluorescent lamp according to claim 1, wherein said fluorescent material comprises a mixture of a long-wavelength excitation type (red) material, a medium-wavelength excitation type (green) material, and a short-wavelength excitation type (blue) material.

3. The fluorescent lamp according to claim 1, wherein said fluorescent material comprises barium, magnesium and aluminum salt doped with europium.

* * * * *

UNITED STATES PATENT AND TRADEMARK OFFICE

CERTIFICATE OF CORRECTION

PATENT NO. : 8,294,352 B2
APPLICATION NO. : 11/918068
DATED : October 23, 2012
INVENTOR(S) : Tadahiro Ohmi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 226 days.

Signed and Sealed this
Twenty-first Day of October, 2014

Michelle K. Lee

Michelle K. Lee
*Deputy Director of the United States Patent and Trademark Office*